United States Patent [19]

Morinaga et al.

[11] Patent Number: 5,003,279

[45] Date of Patent: Mar. 26, 1991

[54] CHIP-TYPE COIL

[75] Inventors: Tetsuya Morinaga; Ryuichi Fujinaga, both of Fukui; Toshimi Kaneko, Sabae; Kiyoshi Nakano, Yawata; Kiyomi Sasaki, Nagaokakyo, all of Japan

[73] Assignee: Murata Manufacturing Co., Ltd., Kyoto, Japan

[21] Appl. No.: 246,827

[22] PCT Filed: Jan. 5, 1988

[86] PCT No.: PCT/JP88/00002

§ 371 Date: Aug. 22, 1988

§ 102(e) Date: Aug. 22, 1988

[30] Foreign Application Priority Data

Jan. 6, 1987 [JP] Japan ..... 62-1509

[51] Int. Cl.[5] ..... H01F 15/10

[52] U.S. Cl. ..... 336/192; 439/886

[58] Field of Search ..... 361/405; 200/265; 439/886, 887, 931; 336/192, 84 C, 219, 83

[56] References Cited

U.S. PATENT DOCUMENTS

| | | | |
|---|---|---|---|
| 3,517,361 | 6/1970 | Reifel et al. | 336/84 C |
| 4,204,863 | 5/1980 | Schreiner | 200/265 X |
| 4,327,349 | 4/1982 | Ettinger et al. | 336/219 |
| 4,687,515 | 8/1987 | Talento | 200/265 X |

FOREIGN PATENT DOCUMENTS

| | | | |
|---|---|---|---|
| 40-22614 | 10/1965 | Japan | 336/192 |
| 55-8885 | 2/1980 | Japan | 336/192 |
| 55-24822 | 6/1980 | Japan | 336/192 |
| 58-68913 | 4/1983 | Japan | 336/192 |

*Primary Examiner*—Thomas J. Kozma

*Attorney, Agent, or Firm*—Wenderoth, Lind & Ponack

[57] ABSTRACT

A chip-type coil whose terminal electrodes are formed directly on a magnetic core and each comprise a mixture of electrically conductive material with insulating material, so that specific resistance of the terminal electrode can increase so as to reduce an eddy current flowing in the terminal electrode, thereby preventing Q-deterioration in the chip-type coil. Moreover, the chip-type coil is allowable of Q-deterioration caused by metal plating, thereby enabling the terminal electrodes to be applied with metal plating.

10 Claims, 3 Drawing Sheets

CHIP-TYPE COIL

FIELD OF THE INVENTION

The present invention relates to a chip-type coil which forms a terminal electrode directly on a magnetic core, and more particularly to a chip-type coil which reduces an eddy current loss at the terminal electrode to prevent Q-deterioration.

BACKGROUND OF THE INVENTION

A chip-type coil as shown in FIG.5 has hitherto been used. The chip-type coil has at both vertical sides of a winding portion 2*a* flanges 2*b* and 2*c*, a winding 4 is wound around the winding portion 2*a* and a pair of terminal electrodes 6*a* and 6*b* for mounting the coil on a printed substrate or the like are formed directly at both lateral sides of the lower flange 2*c*, the wiring 4 being electrically connected at both ends thereof to both the terminal electrodes 6*a* and 6*b* by use of soldering ( not shown ). The terminal electrodes 6*a* and 6*b* are formed of electrically conductive paste, such as silver paste or silver-palladium paste, printed on the surface of the flange 2*c* and baked.

The above-mentioned chip-type coil, however, forms directly on the core 2 the terminal electrodes 6*a* and 6*b* Which are superior in conductivity, whereby the problem is created in that the eddy current loss at the terminal electrodes 6*a* and 6*b* causes Q-deterioration.

In detail, as shown in FIG.6, the magnetic flux 8 caused at the wiring 4 passes through the terminal electrodes 6*a* and 6*b* formed at the flange 2*c*, at which time an eddy current flows in the terminal electrodes 6*a* and 6*b*. The eddy current i can generally be given in rot $i=-K(dB/dt)$, where K is an electrical conductivity: inverse number of specific resistance $\rho$, and B, flux density. In this case, the conventional terminal electrodes 6*a* and 6*b* are formed of silver or silver - palladium and are larger in the conductivity K, so that the eddy current i is larger and an energy loss thereby causes the Q-deterioration.

Also, in order to prevent solder-reaching caused when soldering, it is preferable to apply metal plating of nickel, tin, solder or copper on the surface of the electrode formed of silver or the like. However, the above-mentioned chip-type coil, when metal plating is applied on the surface of terminal electrodes 6*a* and 6*b*, further increases in Q-deterioration, thereby creating the problem in that the metal plating is not applicable to the terminal electrodes.

SUMMARY OF THE INVENTION

The chip-type coil of the invention is characterized in that the terminal electrodes formed at a magnetic core each comprise a mixture of a conductive material with an insulating material.

The conductive material is mixed with the insulating material, thereby enabling the specific resistance of each terminal electrode to increase. Hence, the eddy current at the terminal electrode decreases to prevent the Q-deterioration at the chip-type coil.

Moreover, the Q-deterioration at the terminal electrode is prevented, so that the same caused by metal plating is allowable, thereby enabling the terminal electrode to be applied with metal plating.

BEST MODE FOR CARRYING OUT THE INVENTION

Figure 1:
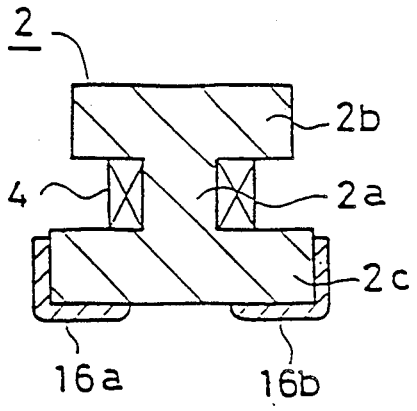
FIG. 1 is a longitudinally sectional view of an embodiment of a chip-type coil of the invention.

Next, the present invention will be detailed in accordance with the accompanying drawings. FIG.1 is a longitudinally sectional view of an embodiment of a chip-type coil of the invention, in which reference numeral 2 designates a magnetic core formed of ferrite or the like, which has flanges 2*b* and 2*c* at both vertical sides of a winding portion 2*a*, 4 designates winding wound around the winding portion 2*a*, and 16*a* and 16*b* designate terminal electrodes which are characteristic of the invention, which are each formed of conductive paste of, for example, silver paste, mixed with insulating material of for example, insulating oxide, such as alumina, silica, titanium oxide, iron oxide, cobalt oxide, nickel oxide, copper oxide, zinc oxide, zirconia, or ferrite powder; insulating nitride, such as $Si_3N_4$ or AlN; or insulating carbide, such as SiC; which are printed directly on the core 2*c* and baked.

Thus, the specific resistance of each terminal electrode 16*a* or 16*b* can be raised in a range allowable in practical use. Therefore, since the eddy current at each terminal electrode, 16*a* or 16*b* decreases, the Q-deterioration of the coil is prevented and a chip-type coil superior in Q is obtained.

Figure 2:
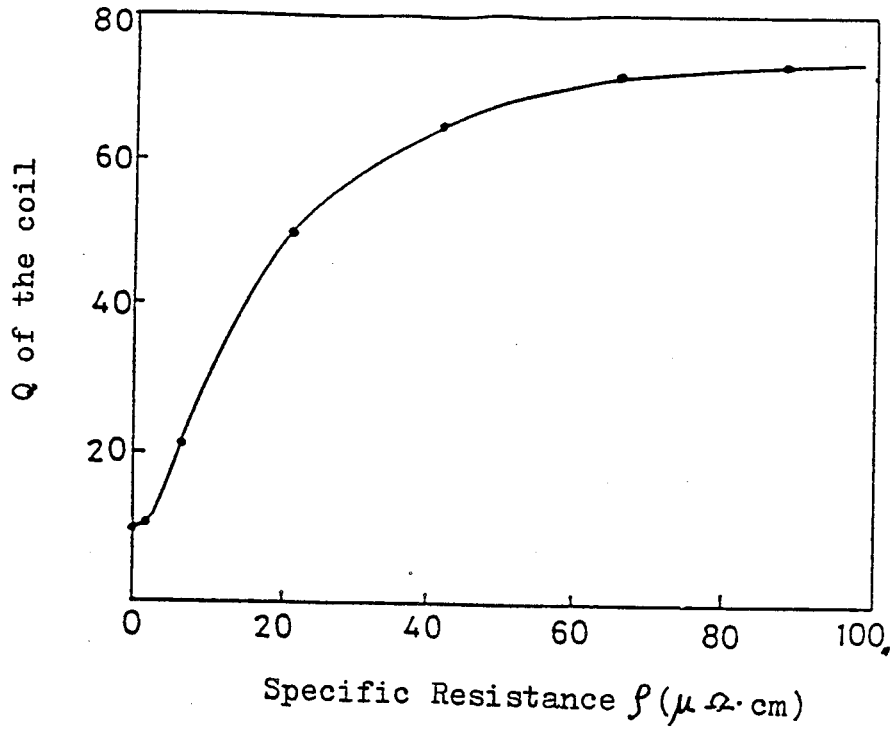
FIG. 2 is a graph showing the relation between specific resistance at the terminal electrode at the chip-type coil in FIG.1 and Q of the coil.
Figure 3:
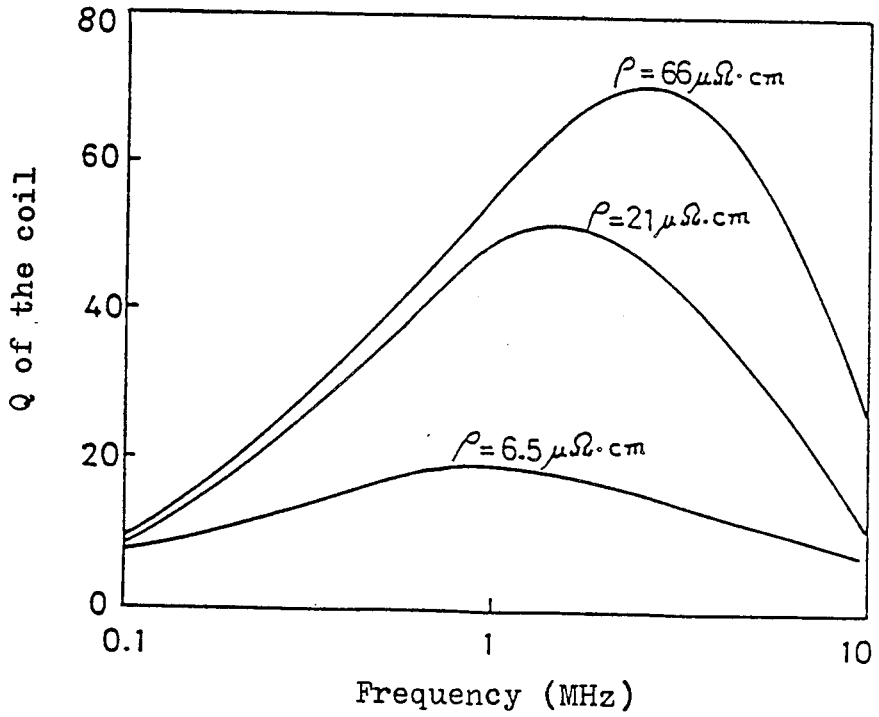
FIG.3 is a graph showing the relation between the frequency at the chip-type coil in FIG.1 and the Q of the coil.
Figure 5:
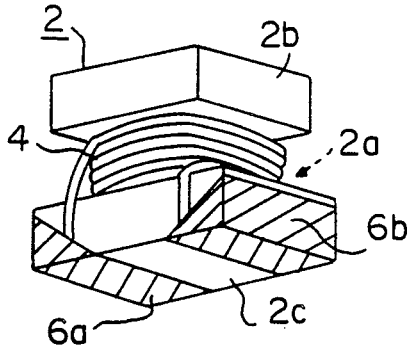
FIG. 5 PRIOR ART
FIG.5 is a perspective view exemplary of the conventional chip-type coil, and FIG.6. is a longitudinally sectional view showing the chip-type coil in FIG.5 together with the magnetic flux.
Figure 6:
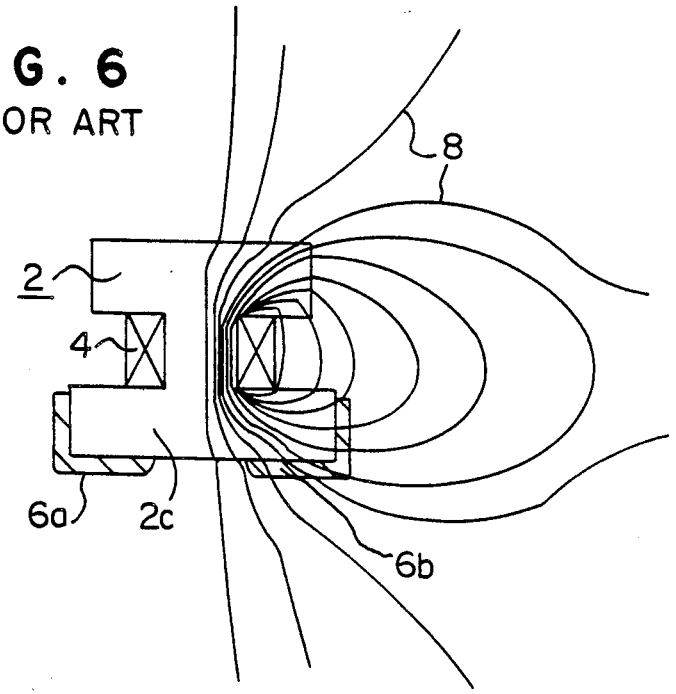
FIG. 6 PRIOR ART

For example, the relation between the specific resistance $\rho$ of the respective terminal electrodes 16*a* and 16*b* and the Q of the coil is as shown in FIG.2, in which when the specific resistance $\rho$ increases up to, for example, about $50\mu\Omega$cm or more, the Q-deterioration can largely be prevented. Incidentally, the specific resistance of about 50 $\mu$cm is obtainable by mixing, for example, alumina powder of about 10 wt. % into the silver paste. As seen from FIG.3, upon increasing the specific resistance $\rho$, especially Q in the high frequency zone is remarkably improved.

Moreover, the Q-deterioration at the terminal electrodes 16*a* and 16*b* are prevented so as to somewhat allow the Q-deterioration caused by metal plating (for example, to an extent of suppressing Q-deterioration at the terminal electrodes 16*a* and 16*b*), thereby enabling the terminal electrodes 16*a* and 16*b* to be applied with various metal plating (for example, nickel, tin, solder or copper plating).

Figure 4:
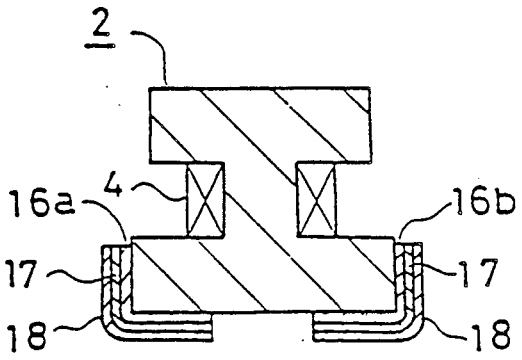
FIG.4 is a longitudinally sectional view of a modified embodiment of the chip-type coil of the invention.

An example of the above is shown in FIG.4, in which, for example, on the surfaces of the terminal electrodes 16*a* and 16*b* formed of silver electrode material of aluminum content of 20 wt. % and specific resistance of $68\mu\omega$cm is plated (for example, electrolytic plating) a nickel layer 17 of 1 $\mu$m or less in thickness and further a tin layer 18 is plated ( the same as above) on the layer 17.

As a result, application of nickel plating reduces solder-reaching of silver electrode caused by soldering, thereby enabling an improvement in sticking strength. Also, the application of tinning improves solder adhesive strength. In brief, the performance of the terminal electrode part has been improved without deteriorating performance (Q) of the coil.

In addition, the terminal electrode as abovementioned is effective entirely when formed directly on the magnetic core, in which the configuration of the core is not confined to the example shown in the drawing but is optional. Accordingly, for example, a barrel-type core or the like can obtain the same effect as the above.

INDUSTRIAL APPLICABILITY

The present invention can reduce the eddy current at the terminal electrode to prevent deterioration in Q of the coil, thereby obtaining a chip-type coil of superior performance. Accordingly, it is possible to apply various metal plating on the terminal electrode, and the chip-type coil which has metal plating applied on the terminal electrode is prevented from solder-reaching during the soldering.

What is claimed is:

1. A chip-type coil having terminal electrodes formed directly on a magnetic core, a winding on said core, said winding being connected to said terminal electrodes, wherein each of said terminal electrodes is formed of a mixture containing an electrically conductive material and an insulating material selected from the group consisting of insulating oxides, nitrides and carbides.

2. A chip-type coil as set forth in claim 1, wherein said electrically conductive material is silver.

3. A chip-type coil as set forth in claim 1, wherein said insulating material is an insulating oxide.

4. A chip-type coil as set forth in claim 3, wherein said insulating oxide is selected from the group consisting of alumina, silica, titanium oxide, iron oxide, cobalt oxide, nickel oxide, copper oxide, zinc oxide, zirconia and ferrite powder.

5. A chip-type coil as set forth in claim 1, wherein said insulating material is an insulating nitride.

6. A chip-type coil as set forth in claim 5, wherein said insulating nitride is selected from the group consisting of $Si_3N_4$ and AlN.

7. A chip-type coil as set forth in claim 1, wherein said insulating material is an insulating carbide.

8. A chip-type coil as set forth in claim 7, wherein said insulating carbide is SiC.

9. A chip-type coil as set forth in claim 1, wherein said terminal electrodes are each applied on the surface thereof with metal plating.

10. A chip-type coil as set forth in claim 9, wherein said metal plating comprises a nickel layer and a tin layer.

* * * * *